United States Patent [19]

Hayatdavoudi

[11] Patent Number: 4,665,981

[45] Date of Patent: May 19, 1987

[54] METHOD AND APPARATUS FOR INHIBITING CORROSION OF WELL TUBING

[76] Inventor: Asadollah Hayatdavoudi, 101 Harwell, La Fayette, La. 70503

[21] Appl. No.: 708,177

[22] Filed: Mar. 5, 1985

[51] Int. Cl.[4] ..... E21B 41/02

[52] U.S. Cl. ..... 166/250; 166/310; 166/902

[58] Field of Search ..... 166/53, 64, 75 R, 113, 166/902, 250, 310, 371

[56] References Cited

U.S. PATENT DOCUMENTS

| | | | |
|---|---|---|---|
| 3,096,819 | 7/1963 | White, Jr. et al. | 166/310 |
| 4,354,553 | 10/1982 | Hensley | 166/250 |
| 4,436,148 | 3/1984 | Maxwell | 166/250 |
| 4,480,687 | 11/1984 | Terral | 166/902 |

OTHER PUBLICATIONS

Paper No. SPE 11185 entitled "Corrosion Mitigation–A Critical Facet of Well Completion Design", by J. Bradburn, presented in 1982 by the Society of Petroleum Engineers.

Brochure of Petrolight Oil Field Chemicals Groups entitled "$CO_2$ EOR/TSA", (c 1984).

Brochure of Petrolight Corporation entitled "Tretolite EOR/TSA Service", (c 1983).

Brochure of Petrolight Corporation entitled "E/R Electrical Resistance Corrosion-Monitoring Instruments", (c 1982).

Brochure of Petrolight Corporation entitled "Corrosion Monitoring", (c 1982).

*Primary Examiner*—Stephen J. Novosad

*Assistant Examiner*—Bruce M. Kisliuk

*Attorney, Agent, or Firm*—Laney, Dougherty, Hessin & Beavers

[57] ABSTRACT

Method and apparatus of inhibiting corrosion of well tubing. A corrosion monitor detects the concentration of a corrosive element in fluid produced from well tubing. Corrosion inhibitor is injected into the tubing by a pump at the depth at which water vapor condenses. A computer is programmed with a formula which generates an optimum concentration of corrosion inhibitor for a given concentration of the corrosive element. The computer is operatively connected to the monitor and receives data therefrom to generate a signal which is used to control the pump speed.

12 Claims, 1 Drawing Figure

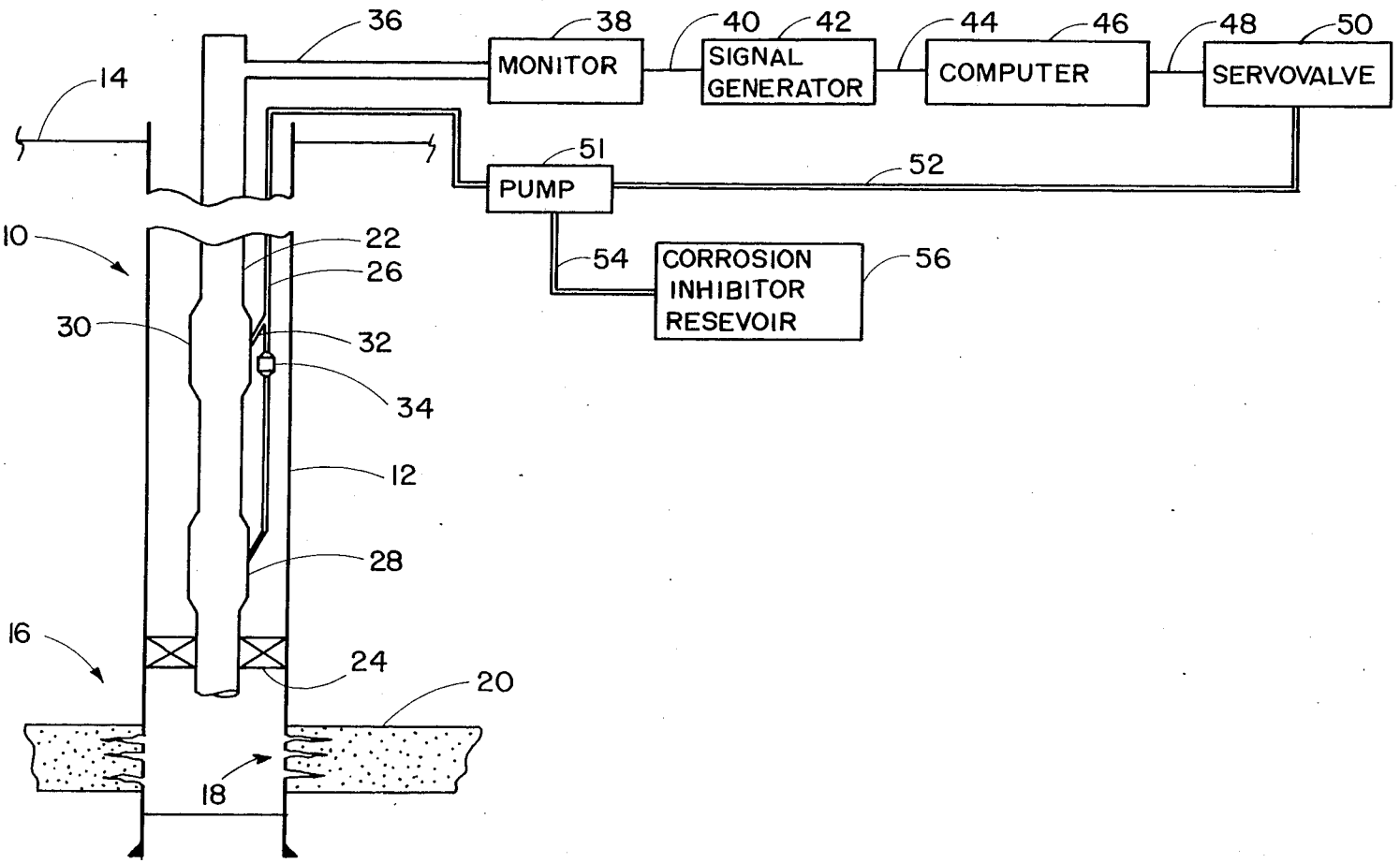
SERVOVALVE
COMPUTER
SIGNAL GENERATOR
MONITOR
PUMP
CORROSION INHIBITOR RESEVOIR
50
48
46
44
42
40
38
36
52
51
54
56
14
10
30
22
26
32
34
12
28
24
20
18
16

METHOD AND APPARATUS FOR INHIBITING CORROSION OF WELL TUBING

BACKGROUND AND SUMMARY OF THE INVENTION

The instant method and apparatus pertains to methods and apparatus for inhibiting corrosion of tubing in a completed well and more particularly, to such methods and apparatus which inject corrosion inhibitor into the tubing.

When fluids are produced through production tubing in a completed well, they may contain elements which corrode the tubing. Such elements often result from the combination of various gases, e.g., carbon dioxide and hydrogen sulfide, with water.

In many wells, below a certain depth, water is in vapor rather than liquid form. As fluids are produced up the well, the water vapor reaches a point in the well at which the temperature, pressure, and volume are such that the vapor condenses. It is at this point and above that the above-mentioned gases may combine with the liquid water to produce elements that corrode the tubing.

Past methods and apparatus for inhibiting corrosion include injection of a known corrosion inhibitor for a given corrosive element into the well tubing. The injection is accomplished by installing a string of injection tubing adjacent the production tubing in the well bore with the lower end of the injection tubing being in communication with the production tubing at a selected well depth. The corrosion inhibitor is pumped into the injection tubing via a pump at the surface.

There are several problems with the above-described prior art technique. The rate of corrosion inhibitor injection is arbitrarily selected. Thus, if too little inhibitor is injected, corrosion may proceed at a faster rate than if more inhibitor were injected. Alternatively, if excess amounts of inhibitor are injected corrosion is not further retarded and inhibitor is wasted. In addition, when inhibitor concentrations reach a sufficient level over the amount necessary to produce maximum corrosion inhibition, polymerization occurs when inhibitor combines with hydrocarbons and other additives such as bactericides in the well fluids. Such polymerization creates a gummy material which can plug valves.

It is a general object of the present invention to provide an improved method and apparatus which overcome the above enumerated disadvantages in the prior art.

It is a more specific object of the present invention to provide an improved method and apparatus which samples the concentration of corrosive elements in production tubing and injects a sufficient amount of corrosive inhibitor to optimize corrosion inhibition.

The method of the instant invention includes the step of monitoring the concentration of the corrosive elment in fluid produced in the well tubing. A corrosion inhibitor is injected into the tubing and the flow rate thereof is varied responsive to the monitored concentration. The injection depth is determined by calculating the depth in the well at which water vapor condenses and injecting inhibitor into the tubing at substantially that depth.

The apparatus of the instant invention includes a corrosion monitor for monitoring the concentration of the corrosive element in the well tubing. The monitor is operatively connected to means for injecting inhibitor into the tubing with the rate of injection being varied responsive to the monitored concentration. These and other objects and advantages of the instant invention will become more fully apparent as the following detailed description of the preferred embodiment of the method and apparatus of the instant invention is read in view of the accompanying drawing.

The drawing is a partially schematic cross-sectional view of a well which has been completed for operation with the apparatus of the instant invention.

DETAILED DESCRIPTION OF THE PREFERRED EMBODIMENT OF THE METHOD AND APPARATUS OF THE INVENTION

Indicated generally at 10 is a completed well. Included therein is an annular casing 12 which extends from the surface 14 to the depth at which fluids enter the well, indicated generally at 16. Fluids enter the well via perforations 18 in the casing from the surrounding strata 20. A string of production tubing 22 extends from the top of the well to a point just above perforations 18. A conventional packer 24 seals the annulus in the well between the casing and the production tubing in the usual fashion.

A string of injection tubing 26 extends from the top of the well to a lower injection valve assembly 28. Assembly 28 is conventional in nature and provides a means for fluid in the injection tubing to enter production tubing 22. An upper injection valve assembly 30 is of substantially the same structure as assembly 28 and serves the same purpose. A branch 32 from injection tubing 26 provides fluid communication between the injection tubing and the upper injection valve assembly.

A conventional valve 34 is provided on the string of injection tubing and may be opened in a conventional manner by providing pressure pulses from the surface to the fluid in the tubing.

At the top of the well, a pipe 36 is in fluid communication with the production tubing at one end and is connected at its other end to a monitor 38. A sample of the fluids being produced from tubing 22 is provided via pipe 36 to monitor 38. The monitor includes a conventional transducer which is sensitive to a corrodent gas of interest, for example, hydrogen sulfide. The monitor generates an electrical signal proportional to the detected concentration to the gas. This signal is provided via a conductor 40 to a signal generator 42. The signal generator conditions the signal from monitor 38 in a conventional fashion and provides the conditioned signal via a conductor 44 to a computer 46.

The computer may be of the analog or digital type and in the instant embodiment of the invention is an analog computer. The computer is programmed with a formula which is derived in a fashion which will be hereinafter explained in greater detail. Included in the computer is an output signal generator which generates electrical signals responsive to the operation of the computer and places them on a conductor 48 which is connected to a conventional servovalve 50. In an embodiment in which computer 46 is of the digital type, servovalve 50 may be replaced by a valve operated by a conventional stepper motor which is controlled by the computer. The servovalve is connected to a conventional hydraulic fluid reservoir and power supply (not shown) and provides the fluid to a conventional hydraulic pump 51 via the usual hydraulic control lines 52. As the signal on conductor 48 is varied, the servovalve is opened and closed to change the rate of flow of fluid in lines 52 and thus the rate of operation of pump 51. The pump is supplied via a pipe 54 with corrosion inhibitor which is stored in a reservoir 56. Varying the speed of pump 51 varies the mass flow rate of corrosion inhibitor which is injected by pump 51 through injection tubing 26 into the production tubing.

Before the above-described embodiment of the invention may be operated, computer 46 must be programmed. In order to program the computer, the optimum concentration of corrosion inhibitor for a given concentration of corrosive element must be determined. When reference is made herein to the "optimum concentration of corrosion inhibitor" or to "optimizing corrosion inhibition" it is meant that corrosion inhibitor is supplied in a quantity sufficient to maximize corrosion inhibition and that no more than this amount is supplied. Supplying corrosion inhibitor in this optimum concentration assures that corrosion will be inhibited to the extent possible and that the inhibitor will not be wasted nor will it produce polymerization in the well.

One of several well-known laboratory tests may be used to measure corrosion rate in order to determine the optimum concentration of corrosion inhibitor for a given concentration of a corrosive element. One such test is known as a corrosion coupon test. In such a test, a piece of metal having a known weight and surface area is placed into a rotating drum having a known concentration of a corrosive element therein. A known quantity of corrosion inhibitor is added after which the rate of corrosion is monitored by weighing the metal and measuring its area. Different drums may be set up with different concentrations of the corrosive element and of the corrosion inhibitor with the rate of corrosion determined for each drum. From such data, a mathmatical function can be derived, in a well-known manner, which generates a number indicative of the optimum concentration of the corrosion inhibitor using a number indicative of the concentration of the corrosive element.

When such a formula is derived, it may be programmed into the computer in a conventional manner. Thus, when the computer is provided with an input signal containing information that indicates the concentration of a corrosive element, an output signal is generated by the computer which contains information that indicates the concentration of corrosion inhibitor for optimizing corrosion inhibition when the concentration of corrosive elements is as indicated by the input signal.

Prior to description of the operation of the apparatus of the instant invention, consideration will be given to the manner in which it is determined at what depth in the well to position upper injector valve assembly 30 along tubing 22. In most wells below a certain depth, the pressure, temperature, and flow in the production tubing are such that water is in its vapor form. Above a certain level in each well, the pressure, temperature, and flow is such that the water vapor condenses. This point is referred to herein as the vapor condensation depth. It is above this depth that liquid water is available to dissolve various gases, e.g., hydrogen sulfide, which results in corrosive elements that damage the tubing. Substantially no corrosion occurs beneath this depth.

Often various logs are run for a well which provide characteristics of the well as a function of depth. For example, pressure, temperature, and flow profiles are commonly run on wells. When the data from such profiles are used in standard thermodynamic equations, the vapor condensation depth may be determined for a particular well. It is at substantially this depth at which upper injector valve assembly 30 is installed.

In the usual producing condition of well 10, fluids from strata 20 enter casing 12 via performations 18 and flow upwardly into tubing 22. Contained in these fluids are various gases which, when combined with water, produce elements which corrode the interior of tubing 22. As described above, the vapor condensation depth is substantially the same as the location of upper injector valve assembly 30. It is at this level that corrosion inhibitor is injected through tubing 26, branch 32, and assembly 30 into the production tubing. Thus, from this level upward, corrosion inhibitor in the production tubing reduces corrosion. As the fluids are produced out the top of tubing 22, a sample of the fluid is provided in pipe 36 to monitor 38 which provides an electrical signal on conductor 40 to signal generator 42 that is proportional to the concentration of a particular corrosive element in the well. The signal generator applies the conditioned signal to conductor 44, the input of computer 46. The programmed computer applies a signal to conductor 48 which is related to the optimum concentration of corrosion inhibitor for the concentration of the corrosive element detected by monitor 38. The signal on conductor 48 is applied to servovalve 50. The servovalve is thereby maintained in position to provide hydraulic fluid to pump 51 at a rate which injects corrosion inhibitor from reservoir 56 to optimize the concentration of corrosion inhibitor for the concentration of the corrosive element detected by monitor 38.

As the flow rate in the well decreases, the vapor condensation depth tends to lower. When such occurs, the fluid in tubing 26 may be pulsed to open valve 34 thus enabling injection at a lower depth.

It is to be appreciated that although monitor 38 is designed to detect only one specific corrosive element, several monitors, each detecting a different element, could be utilized. Also, the system could be easily modified to provide several corrosion inhibitor reservoirs, like reservoir 56, each containing a different corrosion inhibitor for acting on different corrosive elements. The inhibitors could be mixed and injected by the pump at mass flow rates sufficient to optimize the concentration of each of the corrosion inhibitors. It is to be appreciated that other additions and modifications might be made to the above-described method and apparatus of the instant embodiment of the invention without departing from the spirit thereof which is defined in the following claims:

I claim:

1. A method for inhibiting corrosion of production tubing in a well comprising the steps of:

determining an initial vapor condensation depth in the well at which water vapor condenses;

monitoring the concentration of a corrosive element in fluid produced from the production tubing;

injecting a corrosion inhibitor directly into the production tubing at approximately said initial vapor condensation depth; and varying the flow rate of injected corrosion inhibitor responsive to the monitored concentration of the corrosive element.

2. The method of claim 1 which further includes the step of subsequently injecting inhibitor directly into the production tubing at a second injection depth substantially lower that the initial vapor condensation depth, after the vapor condensation depth of the well has changed to a depth substantially below the initial vapor condensation depth.

3. A method for inhibiting corrosion of well production tubing comprising the steps of:

determining an optimum concentration of corrosion inhibitor for different concentrations of a corrosive element;

using the determined concentrations to derive a mathematical formula which expresses the optimum concentration of corrosion inhibitor as a function of the concentration of the corrosive element;

programming a computer with said formula, said computer generating an output signal containing information related to the optimum concentration of corrosion inhibitor when said computer is provided with an input signal containing information related to the concentration of the corrosive element;

generating a control signal containing information related to the monitored concentration;

providing said control signal to said computer thereby generating such an output signal;

determining an initial vapor condensation depth in the well at which water vapor condenses; and injecting corrosion inhibitor directly into the production tubing at substantially that initial vapor condensation depth at a flow rate which varies responsive to said output signal.

4. The method of claim 3 which further includes the step of subsequently injecting inhibitor directly into the production tubing at a second injection depth substantially lower than the initial vapor condensation depth, after the vapor condensation depth of the well has changed to a depth substantially below the initial vapor condensation depth.

5. The method of claim 3, wherein:

said determining step is further characterized as empirically determining said optimum concentration of corrosion inhibitor.

6. The method of claim 3, wherein:

said determining step is further characterized as analytically determining said optimum concentration of corrosion inhibitor.

7. Apparatus for inhibiting corrosion of well production tubing comprising:

a corrosion monitor means for monitoring the concentration of a corrosive element produced from the well production tubing;

selective injection means for selectively injecting corrosion inhibitor into the production tubing at one or more of at least two preselected well depths, said selective injection means including:

first and second injector valve assemblies disposed in said production tubing at a first depth and a lower second depth, respectively, said first depth being approximately equal to an intial vapor condensation depth at which produced water vapor condenses in said production tubing, and said second being substantially lower than said first depth;

injection tubing means connecting a source of corrosion inhibitor to said first and second injector valve assemblies; and selectively operable valve means, disposed in said injection tubing means, for selectively opening and closing said injection tubing means for flow to said second injector valve assembly; and control means for injecting corrosion inhibitor into the tubing at a rate which varies responsive to said monitored concentration.

8. The apparatus of claim 7 which further includes means for generating a signal containing information related to the concentration of said corrosive element, said generating means being operatively connected to said corrosion monitor.

9. The apparatus of claim 8 wherein said apparatus further includes a computer operatively connected to said generating means.

10. The apparatus of claim 9 wherein said computer includes means for generating an output signal containing information related to the optimum concentration of corrosion inhibitor when said computer is provided with an input signal containing information related to the concentration of said corrosive element, said output signal generating means being operatively connected to said injecting means.

11. The apparatus of claim 7 wherein said injecting means comprises an hydraulic pump and wherein said apparatus further includes a servovalve for varying the rate of operation of said pump, said servovalve being operatively connected to said monitor.

12. The apparatus of claim 7, wherein: said valve means is a pulse operated valve means.

* * * * *

UNITED STATES PATENT AND TRADEMARK OFFICE

CERTIFICATE OF CORRECTION

PATENT NO. : 4,665,981

DATED : May 19, 1987

INVENTOR(S) : Asadollah Hayatdavoudi

It is certified that error appears in the above-identified patent and that said Letters Patent are hereby corrected as shown below:

Column 4, line 5, "performations" should be deleted and replaced by "perforations".

Claim 7, line 13, "intial" should be deleted and replaced by "initial"; line 16, between "second" and "being", insert "depth".

Signed and Sealed this

Eighteenth Day of August, 1987

*Attest:*

DONALD J. QUIGG

*Attesting Officer*

*Commissioner of Patents and Trademarks*